United States Patent [19]

Mochizuki et al.

[11] Patent Number: 4,492,545

[45] Date of Patent: Jan. 8, 1985

[54] CAM RING FOR VANE PUMP

[75] Inventors: Norihiro Mochizuki, Inuyama; Hiroyuki Hashizume, Kani, both of Japan

[73] Assignee: Kayaba Kogyo Kabushiki Kaisha, Tokyo, Japan

[21] Appl. No.: 364,357

[22] Filed: Apr. 1, 1982

[30] Foreign Application Priority Data

Apr. 6, 1981 [JP] Japan ..... 56-49270

[51] Int. Cl.[3] ..... F04C 2/00; F04C 15/00

[52] U.S. Cl. ..... 418/149; 418/152; 418/178; 418/179

[58] Field of Search ..... 418/152, 178, 179, 149, 418/259–269

[56] References Cited

U.S. PATENT DOCUMENTS

| | | | |
|---|---|---|---|
| 2,816,702 | 12/1957 | Woodcock | 418/149 X |
| 3,130,673 | 4/1964 | Finstad | 418/152 X |
| 3,601,513 | 8/1971 | White | 418/179 X |
| 3,622,254 | 11/1971 | LeBlanc | 418/179 X |
| 3,878,880 | 4/1975 | Jones | 418/178 X |
| 4,182,602 | 1/1980 | Dworak et al. | 418/149 X |
| 4,260,343 | 4/1981 | Watanabe et al. | 418/269 |

FOREIGN PATENT DOCUMENTS 2918554 11/1980 Fed. Rep. of Germany ..... 418/178

OTHER PUBLICATIONS

Koehring, Roland, Powder Metallurgy Advances, SAE Journal, Feb. 1963, pp. 39–41.

Baumeistes, *Standard Handbook for Mechanical Engineers*, 1967, New York, McGraw Hill, pp. 6–89, 6–120, 6–121.

*Primary Examiner*—John J. Vrablik

*Assistant Examiner*—Theodore Olds

*Attorney, Agent, or Firm*—Jordan and Hamburg

[57] ABSTRACT

In a cam ring of a vane pump having a contoured bore whole wall is constantly and slidingly engaged by the radially outermost ends of vanes during rotation of a rotor, a radially inner part of the cam ring including the wall of the contoured bore is formed of sintered alloy while a radially outer part surrounding the inner part is formed of a material which prevents working fluid from oozing out therethrough. The outer part comprises a moulding of plastics, a die casting or a piece blanked from a steel sheet.

19 Claims, 9 Drawing Figures

CAM RING FOR VANE PUMP

BACKGROUND OF THE INVENTION

The present invention relates to a vane pump which serves as a source of hydraulic fluid pressure mainly for a power steering system of a motor vehicle and, more particularly, to an improved cam ring for such a vane pump.

A vane pump of the type described is generally driven by an engine mounted on a motor vehicle to deliver a hydraulic fluid under pressure for operating a power cylinder, which is adapted to assist the operator of the motor vehicle in manipulating the steering wheel. Such a vane pump commonly includes a rotor carrying a plurality of vanes therewith, a cam ring receiving the rotor in its contoured bore, a pump shaft driving the rotor for rotation, a pump housing connected to one axial end of the rotor and cam ring, and a cover plate covering the other axial end of the rotor and cam ring and connected to the pump housing by suitable fastening means.

The cam ring must be highly resistive to wear and provide for good lubrication inasmuch as the radially outermost ends of the vanes slide in direct contact with the wall of the contoured bore in the course of rotation of the rotor. An implement heretofore proposed for meeting this requirement consists in sintering alloy powder which contains nickel (Ni), molybdenum (Mo), copper (Cu), or chromium (Cr), for example. The sintered alloy permits a working fluid to well infiltrate into its porous structure so that good lubrication and wear resistivity can be achieved. This enhances the performance and durability of the vane pump. Naturally, the exposed outer periphery of the cam ring is treated for preventing the working fluid from oozing out therefrom.

However, the use of such costly alloy powder for the cam ring contributes to an increase in the production cost of the whole vane pump.

SUMMARY OF THE INVENTION

A vane pump provided with a cam ring embodying the present invention has a rotor which carries a plurality of vanes therewith for cooperation with a contoured inner wall of the cam ring. The cam ring comprises an inner ring member having the contoured inner wall which defines a contoured bore for rotatably accommodating the rotor therein. The inner ring member is made of a first material which is highly resistive to wear and provides for good lubrication. The cam ring further comprises an outer ring member for receiving the inner ring member therein. The outer ring member is made of a second material through which working fluid is non-infiltratable.

In accordance with the present invention, in a cam ring of a vane pump having a contoured bore whose wall is constantly and slidingly engaged by the radially outermost ends of vanes during rotation of a rotor, a radially inner part of the cam ring including the wall of the contoured bore is formed of sintered alloy while a radially outer part surrounding the inner part is formed of a material which prevents working fluid from penetrating or oozing out therethrough. The outer part comprises a moulding of plastics, a die casting or a piece blanked from a steel sheet.

It is an object of the present invention to provide a vane pump having a cam ring which is made of a relatively incostly material.

It is another object of the present invention to provide a new vane pump which is excellent in performance and durability.

It is another object of the present invention to provide a generally improved vane pump.

Other objects, together with the foregoing, are attained in the embodiments described in the following description and illustrated in the accompanying drawings.

DESCRIPTION OF THE PREFERRED EMBODIMENTS

While the vane pump of the present invention is susceptible of numerous physical embodiments, depending upon the environment and requirements of use, substantial numbers of the herein shown and described embodiments have been made, tested and used, and all have performed in an eminently satisfactory manner.

Figure 1:
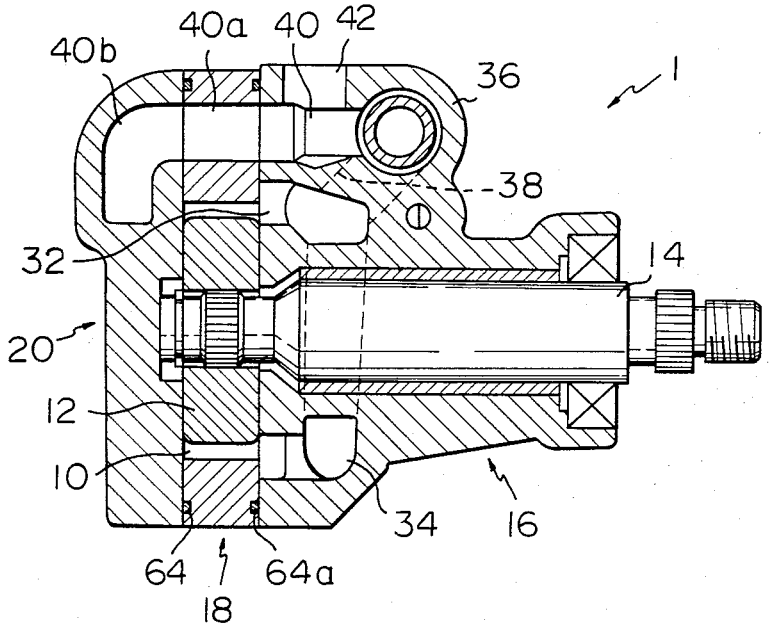
Fig. 1 PRIOR ART
FIG. 1 is a sectional side elevation of a prior art vane pump to which the present invention is applicable.
Figure 2:
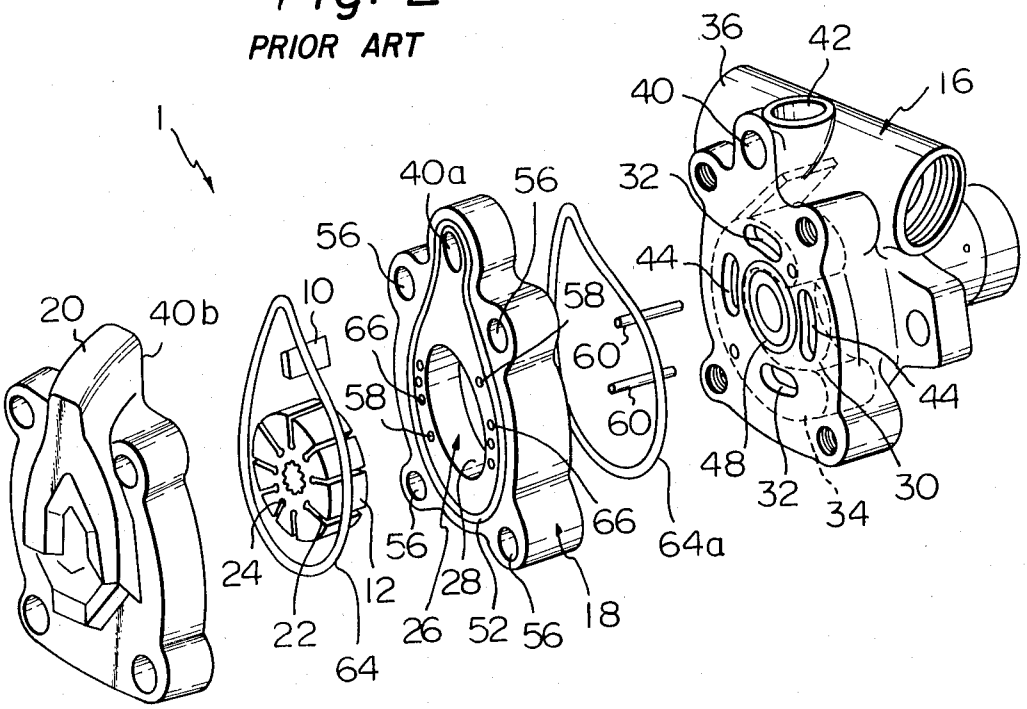
Fig. 2 PRIOR ART
FIG. 2 is an exploded perspective view of the vane pump shown in FIG. 1.

Referring to FIGS. 1–7 of the drawings, there is shown a vane pump generally designated by the reference numeral 1 and to which the present invention is applicable. As shown in FIGS. 1 and 2, the vane pump principally comprises a rotor 12 having vanes 10 therewith, a pump shaft 14 for driving the rotor 12 for rotation, a pump housing 16 by which the pump shaft 14 is rotatably supported, a cam ring 18 surrounding the rotor 12, and a cover plate 20 fastened to the pump housing 16 by suitable clamping means such as bolts (not shown) with the cam ring 18 and rotor 12 held therebetween.

As viewed in FIG. 2, the vanes 10 (only one is shown in FIG. 2) are received radially movably in radial slots 22 which are formed in the rotor 12. The vanes 10 are constantly urged against a contoured cam surface 28 of the cam ring 18 which defines a contoured bore 26, by the delivery pressure of the pump communicated to the radially innermost portions of the slots 24 and the centrifugal forces resulting from the rotation of the rotor 12.

Figure 5:
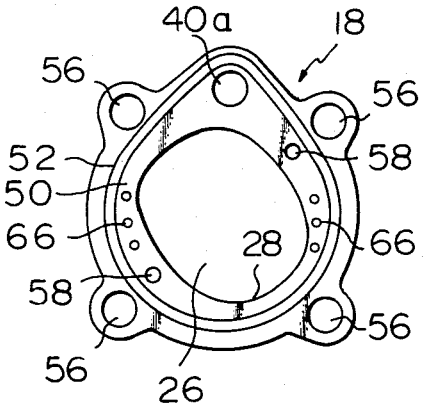
Fig. 5 PRIOR ART
FIG. 5 is a front view of a cam ring of the vane pump of FIG. 1.

As shown in FIG. 5, the cam surface 28 of the cam ring 18 is substantially oval in cross-section. While the rotor 12 is rotating with the vanes 10 pressed against the oval cam surface 28, a working chamber defined by two adjacent vanes 10, rotor 12 and cam surface 28 undergoes an increase (suction stroke) and a decrease (delivery stroke) in volume each by two times for one full rotation of the rotor 12.

Figure 7:
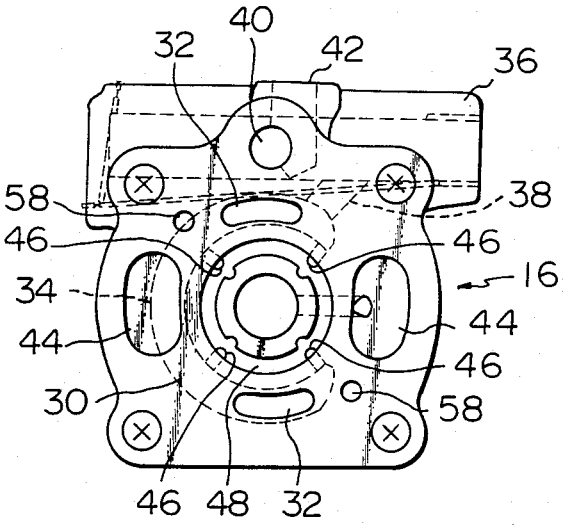
Fig. 7 PRIOR ART
FIG. 7 is a front view of a pump housing of the vane pump shown in FIG. 1.

The pump housing 16, as seen in FIGS. 2 and 7, is formed with outlet ports 32 on that surface 30 with which the vanes 10 are slidably engaged and in predetermined positions where each working chamber defined as described performs delivery strokes.

The pump housing 16 has thereinside a high pressure chamber 34 formed by casting with a core; the chamber 34 is in fluid communication with the outlet ports 32. The pump housing 16 is also formed with a substantially cylindrical valve housing section 36 adapted to receive a flow control valve (not shown) thereinside. The high pressure chamber 34 is communicated by a passageway 38 (FIG. 1) to the inlet side of the flow control valve. The excess fluid return side of the flow control valve is connected with inlet ports, which will be described, by a passageway 40. The passageway 40 is communicated with a suction port 42 which is open at a position which is as close as possible to the excess fluid return side of the flow control valve.

Figure 3:
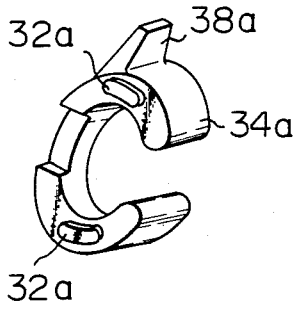
Fig. 3 PRIOR ART
FIG. 3 is a perspective view of a core for defining a high pressure chamber in the vane pump.

FIG. 3 indicates a core which will be used to form the outlet ports 32, high pressure chamber 34 and passageway 38 in the pump housing 16 by casting. As shown, the core has an arcuate body portion **34*a* to form the high pressure chamber 34, a lug 38*a* extending radially from the body portion to form the passageway 38, and a pair of lugs 32*a* on an end of the body portion 34*a* to form the outlet ports 32**, respectively.

The slide surface 30 of the pump housing 16 is formed with recesses 44 which face the inlet ports, and an annular recess or groove 48 which has communication with the high pressure chamber 34 through radially formed drilled holes 46 (FIG. 7). The annular groove 48 functions to distribute the hydraulic fluid force transmitted thereto from the high pressure chamber 34 into the radially innermost portions of the slots 24 of the rotor 12, so that the vanes 10 will be urged against the cam surface 28 of the cam ring 18 in the manner previously discussed.

As shown in FIG. 5, the cam ring 18 has a contour which is substantially common to that of the pump housing 16 or of a cover plate 20, which will be described, as seen in a front view.

Besides the aforesaid cam surface 28, the cam ring 18 has a passageway **40*a* which extends therethroughout to be aligned with the passageway 40 of the pump housing 16**.

Shown in FIG. 5 is that surface 50 of the cam ring 18 which will be engaged by the cover plate 20. This engagement surface 50 is formed with an annular sealing recess or groove 52 which encloses the passageway **40*a* and cam surface 28** thereinside.

Figure 6:
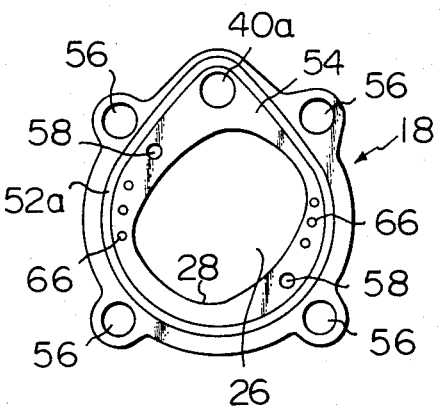
Fig. 6 PRIOR ART
FIG. 6 is a rear view of the cam ring.

FIG. 6 indicates the other surface 54 of the cam ring 18 which will be engaged by the pump housing 16. This engagement surface 54, like the engagement surface 50, is formed with an annular sealing recess or groove **52*a* similar to the sealing recess or groove 52. As seen in FIGS. 5 and 6, holes 56 are drilled in the cam ring 18 to pass bolts therethrough when the cover plate 20, cam ring 18 and pump housing 16 are to be bolted together with the cam ring 18 sandwiched between them. Additionally, holes 58 are formed in the cam ring 18 so that knock pins 60 (see FIG. 2) may be passed therethrough to properly position the cam ring 18 relative to the pump housing 16 and cover plate 20**.

Figure 4:
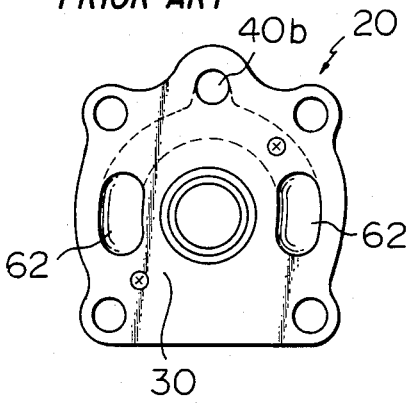
Fig. 4 PRIOR ART
FIG. 4 is a rear view of a cover plate included in the vane pump of FIG. 1.

As also shown in FIG. 4, the cover plate 20 is formed with inlet ports 62 on a surface 30 thereof with which the vanes 10 on the rotor 12 are slidably engaged and in positions where they will communicate with specific working chambers in suction stroke. A passageway **40*b* is formed in the cover plate 20 to be communicated with the passageway 40*a* in the cam ring 18. The passageway 40*b* is slowly bifurcated within the cover plate 20 such that the individual ends of the bifurcated portion open at the slide surface 30 of the cover plate 20 as the inlet ports 62**, respectively.

As stated hereinbefore, the cover plate 20 is locked to the pump housing 16 by bolts (not shown) holding the rotor 12 with vanes 10 and the cam ring 18 therebetween. As seen in FIG. 2, the cam ring 18 is clamped tight between the cover plate 20 and the pump housing 16 with oil seals (O-rings) 64 and **64*a* received in the individual sealing grooves 52 and 52*a* in the cam ring 18**.

The vane pump having the above construction and arrangement will be operated as follows.

A working chamber is defined by the opposite slide surfaces 30 of the pump housing 16 and cover plate 20 in addition to the adjacent vanes 10, rotor 12 and cam surface 28 of the cam ring. As the pump shaft 14 is rotated to drive the rotor 12 for rotation, the working chamber repeatedly performs a delivery stroke and a suction stroke in the manner already defined.

Pressurized hydraulic fluid forced out of the working chamber during a delivery stroke is admitted into the high pressure chamber 34 of the pump housing through an outlet port 32 and then into the flow control valve via the passageway 38.

The flow control valve, as well known in the art, supplies a load with only the pressurized fluid controlled to a predetermined flow rate while releasing the excess fluid to the passageway 40.

This part of the fluid released to the passageway 40 flows through the intercommunicated passageways **40*a* and 40*b* and in the course of this movement, it joins a fresh supply of fluid which is fed from a tank or reservoir (not shown) via the suction port 42. Here, the suction port 42 is open at a position where the velocity of the fluid flow returned from the flow control valve is highest and the pressure is the lowest. This affords the so-called supercharging effect with the maximum efficiency so that the fresh flow of fluid from the reservoir can advance positively from the suction port 42 into the passageway 40 or 40*a***.

The combined fluid flow at the passageway 40 or **40*a* moves therefrom to the inlet ports 62 of the cover plate 20 by way of the passageway 40*b*. At this instant, the velocity energy of the fluid flow is partly transformed into pressure energy, which causes the fluid to flow into working chambers in suction stroke efficiently through the inlet port 62 and passageway 66 formed in the cam ring 18. Since the excess fluid return side of the flow control valve or the suction port 42 of the pump has fluid communication with the inlet ports 62 via the slowly intercommunicated passageways 40, 40*a* and 40*b*, the flow of fluid to the inlet ports 62** involves a minimum of pressure loss and therefore contributes to an increase in the operating efficiency of the pump.

It will be seen that the two oil seals 64 and **64*a* serve to keep working chambers and passageways 40, 40*a* and 40*b*** fully liquid-tight during suction and delivery strokes.

The cam ring 18 of the vane pump 1 described above comprises an integral body formed by blanking or like technique. The whole cam ring 18 is made of sintered alloy in order to attain sufficient lubrication and wear resistivity for the cooperation of its cam surface 28 with the radially outermost ends of the vanes 10. However, sintered alloy is quite expensive and so invites a disproportionate increase in production cost.

Figure 9:
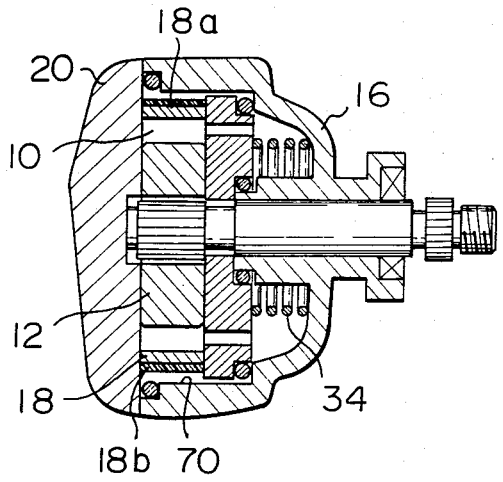
FIG. 9 is a section showing another form of the vane pump to which the present invention is applicable.
Figure 8:
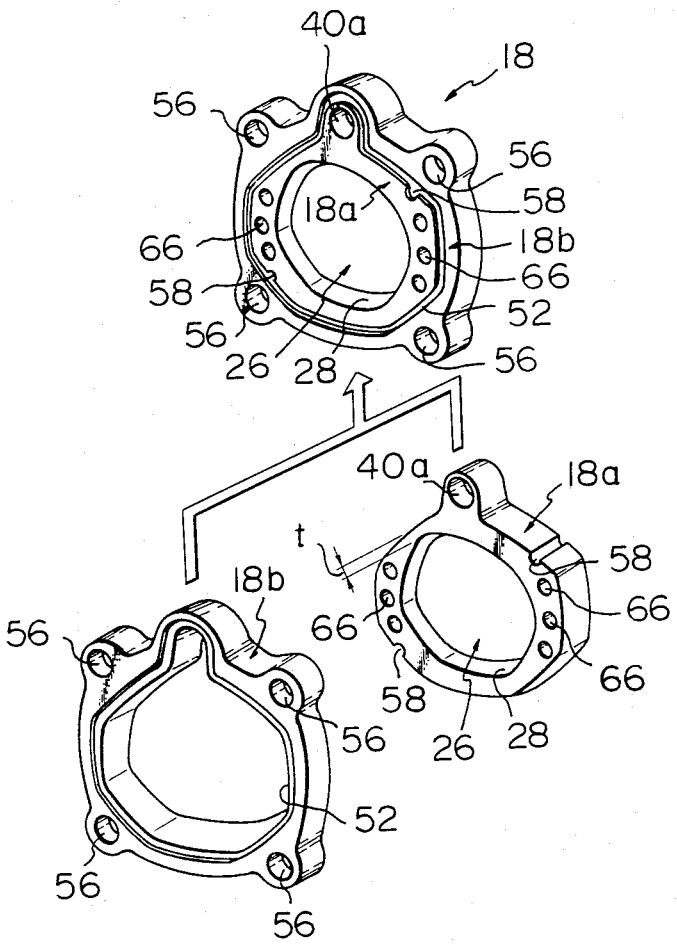
FIG. 8 is an exploded perspective view of a cam ring embodying the present invention.

Referring to FIGS. 8 and 9, a cam ring in accordance with the present invention is shown which is free from the drawback mentioned above. In these drawings, parts and elements common to those of FIGS. 1–7 are designated by the same reference numerals.

As seen in FIG. 8, the cam ring generally designated by the reference numeral 18 comprises an integral assembly of an inner ring member 18*a* formed of sintered alloy and an outer ring member 18*b* formed of plastics or like relatively incostly material.

The inner ring 18*a* includes a passageway 40*a* and passageways 66 which connect a bifurcated passageway 40*b* of a cover plate 20 to recesses 44 of a pump housing 16. The thickness t of the inner ring 18*a* is designed to withstand the fluid pressure which will act in a contoured bore 26. It should be noted, however, that the thickness t is not even; it is comparatively small in those portions where working chambers undergo suction strokes and comparatively large in those portions where they undergo delivery strokes and, therefore, the fluid pressure is high.

The outer ring 18*b* on the other hand is formed with annular recesses or grooves 52 and 52*a* in its axially opposite engagement surfaces, respectively, in such a manner as to surround the inner ring 18*a*. The contour of the outer ring 18*b* is the same as those of the engagement surfaces of the pump housing 16 and cover plate 20.

The inner ring 18*a* and outer ring 18*b* may be united together by, during injection moulding of the outer ring 18*b*, placing the sintered inner ring 18*a* in the injection mold and then injecting plastic material. Another possible method may be forming the inner ring 18*a* and outer ring 18*b* as separate members and then fitting them together (clearance fit, transition fit or close fit) before grinding the engagement surfaces.

Thus, the combined use of sintered alloy for the inner ring 18*a* and a relatively inexpensive material for the outer ring 18*b* saves the amount of the expensive alloy powder, thereby cutting down the production cost to a significant extent.

The outer ring 18*b* formed of plastics in this embodiment does not need any treatment on its outer periphery for preventing the working fluid from penetrating or oozing out (e.g. plating or impregnating polyester resin to stop up the porous structure). Apart from such advantage, the use of plastics reduces the weight of the cam ring 18 and, therefore, the overall weight of the vane pump.

The illustrated configuration of the inner ring 18*a* is not limitative. The gist is that the thickness distribution of the inner ring 18*a* is well calculated to withstand the fluid pressure acting in the contoured bore 26. Thus, the passageways 40*a* and 66 may be formed in the outer ring 18*b* instead of the inner ring 18*a*, but not the holes 58.

While the outer ring 18*b* has been described as being formed of plastics, it may comprise a die casting of zinc alloy or aluminum or a casting of aluminum. In this case, the lost wax process is preferable to further increase the precision of the product.

Furthermore, the outer ring 18*b* may be prepared by blanking a steel sheet to the predetermined shape of the outer ring 18*b*. Where the thickness of the outer ring 18*b* is greater than the blanking limit, a plurality of blanked plates may be stacked together without any clearance.

The present invention is also applicable to such a usual type of vane pump as that shown in FIG. 9, in which the cam ring 18 is not fastened together with the pump housing 16 or cover plate 20. In this type of vane pump, the cam ring 18 is bodily received in a hollow cylindrical recess 70 of the pump housing 16 and entirely shaded from the outside by the pump housing 16 along its outer periphery. This eliminates the need for the anti-ooze treatment against working fluid. Thus, the outer ring 18*b* may be formed by sintering Fe-C alloy powder or Al powder, for example, which is cheaper than the alloy powder used for the inner ring 18*a*.

In summary, it will be seen that the present invention saves the amount of expensive sintered alloy which constitutes a cam ring of a vane pump and thereby cuts down the production cost of the vane pump. Yet, the cam ring in accordance with the invention is comparable in performance and durability to a prior art cam ring which is entirely formed of sintered alloy.

Various modifications will become possible for those skilled in the art after receiving the teachings of the present disclosure without departing from the scope thereof.

What is claimed is:

1. A cam ring for a vane pump for a power steering system of a motor vehicle, the vane pump having a rotor which carries a plurality of vanes therewith for cooperation with a contoured inner wall of the cam ring, the cam ring comprising:

an inner ring member having two side walls and a contoured inner wall which defines a noncircular contoured bore for rotatably accommodating the rotor therein, said inner ring member having a passageway therein extending from one of said two side walls to the other of said two side walls and through which liquid to be pumped flows, said passageway being located radially outwardly of said contoured inner wall, said inner ring member being made of a sintered alloy material which is highly resistive to wear and provides for good lubrication;

an outer ring member receiving the inner ring member therein, said outer ring member being made of a second material other than sintered alloy, said second material having the property of being non-infiltratable by the working fluid, said outer ring member having a recess extending radially outwardly of said passageway, and an oil seal means in said recess, said oil seal means being disposed radially outwardly of said passageway, said oil seal means preventing the working fluid from leaking between said inner and outer ring members.

2. A cam ring according to claim 1, wherein said outer ring member has an inner opening with a configuration conforming substantially to the configuration of the outer periphery of said inner ring member, said recess being disposed about the periphery of said inner opening, said oil seal means engaging the walls of said recess and the outer periphery of said inner ring member.

3. A cam ring according to claim 2, wherein said cam ring is sandwiched between a pump housing and a cover plate, said oil seal means comprising an oil seal ring providing a seal between said cam ring and said pump housing and another oil seal ring providing a seal between said cam ring and said cover plate.

4. A cam ring according to claim 1, wherein said inner ring member has a variable radial thickness with the thinner parts being located in those positions where the working chambers undergo suction strokes and the thicker portions where the working chambers undergo delivery strokes.

5. A cam ring as claimed in claim 1, in which the second material constituting the outer ring member comprises plastics in the form of a moulding.

6. A cam ring as claimed in claim 1, in which the second material comprises zinc alloy in the form of a die casting.

7. A cam ring as claimed in claim 1, in which the second material comprises aluminum in the form of a die casting.

8. A cam ring as claimed in claim 1, in which the second material comprises aluminum in the form a casting.

9. A cam ring as claimed in claim 1, in which the second material comprises steel in the form of a sheet from which the outer ring member is blanked.

10. A cam ring as claimed in claim 1, in which the second material comprises sintered Fe-C alloy.

11. A cam ring as claimed in claim 1, in which the second material comprises sintered aluminum.

12. A vane pump for a power steering system of a motor vehicle, comprising a cam ring disposed between a pump housing means and a cover plate means, a rotor carrying a plurality of vanes therewith for cooperation with a contour in a wall of said cam ring, said cam ring being divided into an inner section and an outer section, said inner section comprising an inner ring member having an outer wall and a contoured inner wall which defines a noncircular contoured bore for rotatably accommodating the rotor therein, said inner ring member also having two side walls, said inner ring member having a passageway therein extending between said two side walls through which liquid to be pumped flows from said pump housing means to said cover plate means, said passageway being located radially outwardly of said contoured inner wall, said inner ring member being made of a sintered alloyed material which is highly resistant to wear and provides for good lubrication, said outer section comprising an outer ring member receiving the inner ring member therein, said outer ring member being made of a material other than sintered alloy, said other material having the property of being non-infiltratable by the working fluid, said outer ring member having an inner wall, said outer ring member having two recesses along the edges of said inner wall, said recesses extending radially outwardly of said passageway, and two oil seal rings in said respective recesses extending radially outwardly of said passageway and preventing the working fluid from leaking between said inner and outer ring members and which provides a seal between said cam ring and said pump housing means and between said cam ring and cover plate means.

13. A vane pump according to claim 12 further comprising passages in said cam ring receiving knock pins to position said cam ring relative to said pump housing means and said cover plate means, said passages being disposed in said inner ring member.

14. A vane pump according to claim 12, wherein said cover plate means and said pump housing means have aligned holes for receiving bolts to hold said cover plate, said pump housing means and said cam ring in assembled position, said outer ring member having a passageway aligned with passageways in said cover plate means and said pump housing means.

15. A vane pump for a power steering system of a motor vehicle, comprising a cam ring disposed between a pump housing means and a cover plate means, a rotor carrying a plurality of vanes therewith and at least partially defining working chambers therebetween, said vanes cooperating with a contoured wall of said cam ring, said cam ring being divided into an inner section and an outer section, said inner section comprising an inner ring member having an outer wall and said contoured inner wall which defines a noncircular contoured bore for rotatably accommodating the rotor therein, said inner ring member also having two side walls, said inner ring member having a passageway therein extending between said two side walls through which liquid to be pumped flows from said pump housing means to said cover plate means, said passageway being located radially outwardly of said contoured inner wall, said inner ring member being made of a sintered alloyed material which is highly resistant to wear and provides for good lubrication, said outer section comprising an outer ring member receiving the inner ring member therein, said outer ring member being made of a material other than sintered alloy, said other material having the property of being non-infiltratable by the working fluid, said inner ring member having a variable radial thickness with the thinner parts being located in those portions where the working chambers undergo suction strokes and the thicker portions where the working chambers undergo delivery strokes, passages in said cam ring receiving knock pins to position said cam ring relative to said pump housing means and said cover plate means, said passages being disposed in said inner ring member, said outer ring member having an inner opening with a configuration conforming substantially to the configuration of the outer periphery of said inner ring member, a recess disposed about the periphery of said inner opening, said recess extending radially outwardly of said passageway, and oil seal means extending radially outwardly of said passageway and engaging the walls of said recess and the outer periphery of said inner ring member to prevent working fluid from leaking between said inner and outer ring members, said oil seal means comprising an oil seal which also provides a seal between said cam ring andsaid pump housing means and another oil seal means which provides a seal between said cam ring and said cover plate means.

16. A cam ring according to claim 15, wherein said inner ring member has a generally radially disposed projection, said passageway being formed in said projection.

17. A cam ring according to claim 16, wherein said outer ring member has a groove for receiving said projection.

18. A cam ring according to claim 17, wherein said projection has an outer wall of a generally U-shaped configuration, said groove having a corresponding generally U-shaped configuration.

19. A cam ring according to claim 18, wherein said groove defines part of said inner opening of said outer ring member, said recess extending about the periphery of said groove, said oil seal means engaging the walls of said recess as said recess extends about the periphery of said groove.

* * * * *